US009211022B2

(12) United States Patent
Broussard

(10) Patent No.: US 9,211,022 B2
(45) Date of Patent: Dec. 15, 2015

(54) COMPARTMENTALIZED BED SKIRT ASSEMBLY

(71) Applicant: Zina L. Broussard, Sugarland, TX (US)

(72) Inventor: Zina L. Broussard, Sugarland, TX (US)

( * ) Notice: Subject to any disclaimer, the term of this patent is extended or adjusted under 35 U.S.C. 154(b) by 15 days.

(21) Appl. No.: 14/072,721

(22) Filed: Nov. 5, 2013

(65) Prior Publication Data

US 2015/0121622 A1 May 7, 2015

(51) Int. Cl.
*A47G 9/02* (2006.01)

(52) U.S. Cl.
CPC ..... *A47G 9/0292* (2013.01)

(58) Field of Classification Search
CPC ..... A47G 9/0284; A47G 9/0292
USPC ..... 5/482, 485, 486, 493, 907; 160/124, 160/348
See application file for complete search history.

(56) References Cited

U.S. PATENT DOCUMENTS

| | | | | |
|---|---|---|---|---|
| 2,763,875 | A * | 9/1956 | Piontkowski | 5/493 |
| 6,151,731 | A * | 11/2000 | Saparow | 5/493 |
| 2004/0016055 | A1* | 1/2004 | Lamy | 5/485 |
| 2009/0113629 | A1* | 5/2009 | Tucker | 5/485 |
| 2012/0042450 | A1* | 2/2012 | Hamilton et al. | 5/493 |

* cited by examiner

*Primary Examiner* — Michael Trettel

(57) ABSTRACT

A compartmentalized bed skirt assembly for use over a box spring of a bed being formed with a top portion generally configured in a rectangular shape that conventionally covers the box spring portion of a mattress set fitting between the box spring and the mattress. Vertically extended portions are secured to the top portion of the bed skirt and extends downward to the floor on two sides and at the foot end of the bed. The vertically extended portions forms a series of panels or flaps that touch or slightly overlaps an adjacent flap, each flap being totally independent from the adjacent flap to allow lifting of the flap to the point of touching the mattress that rests on top of the box spring. The lifting of a panel or flap does not cause lifting of the adjacent panel or flap.

11 Claims, 2 Drawing Sheets

COMPARTMENTALIZED BED SKIRT ASSEMBLY

CROSS-REFERENCE TO RELATED APPLICATIONS

None

FEDERALLY SPONSORED RESEARCH

Not Applicable

SEQUENCE LISTING OR PROGRAM

Not Applicable

FIELD OF THE INVENTION

The invention generally relates to bedding and particularly to an improved bed skirt.

BACKGROUND OF THE INVENTION

Bed skirts, also commonly called Dust Ruffles, are used as an aesthetic covering for the sides and foot portion of the box spring, frame and open area under a bed between the bed frame and the floor. Bed skirts also reduces the accumulation of dust underneath the bed, hence the alternate name Dust Ruffle. A third and common reason for the use of a bed skirt is to provide privacy for the items one has stored underneath the bed. Current bed skirts typically include a top portion that is usually rectangular in shape and made of a flat sheet type material. The top portion has a perimeter that usually matches or approximates the perimeter of the box spring it covers. The top portion may have elastic along its perimeter for gripping the upper area of the box spring to prevent unwanted movement. Alternatively, the top portion will sometimes have "U" shaped elastic or fastening material at its four corners for fitting over the four corners of the box spring to accomplish the same prevention of movement. A vertically extended portion is attached to the top portion on two sides and at the foot end of the bed and extends downward to the floor. This vertical portion or ruffle is typically one continuous piece of fabric going around the entire perimeter of the bed except for the head end of the bed. The head end of the bed typically does not have a vertical extended portion as it is typically against a wall and shielded by a head-board. In the rare case that a bed skirt does have a head end vertical portion, that vertical portion typically will not extend beyond the depth of the box spring and is there to only to provide a greater stability for the prevention of movement for the bedskirt.

PRIOR ART

Some developments in the prior art in recent years have focused on the top flat portion of the bed skirt. Both U.S. Pat. Nos. 4,141,097 and 5,621,931 describe a bed skirt with a top portion that either has a non-slip surface or otherwise grips the upper portion of the box spring through retaining panels made with elastic thread or an elastic seam. The vertical portions of these bed skirts maintain the traditional style whereby both vertical side portions and the rear or foot end vertical portion is composed of a singular and continuous piece of fabric along the entire length of all three sides or alternatively forming a total of three separate but lengthy pieces of material whereby each side is covered by a singular piece of fabric. The drawback is that this singular long piece of fabric per side is bulky and cumbersome to raise in just one small or specific section of the fabric. Thus one is forced to raise the entire length of material and expose all of the contents stored under the bed on that particular side in order to locate and retrieve even a small storage container.

Realizing that bed heights vary according to the varying heights of bed frames and box springs, the prior art has also produced bed skirts of adjustable heights to eliminate the requirement of buying a bed skirt that fits only a singular bed height. U.S. Pat. No. 5,353,456 describes a height adjustable bed skirt with the ease of removal of the ruffle or vertical extended portion for cleaning without the necessity of removing the mattress or the top portion of the bed skirt. It accomplishes this adjustment of height by letting out overlapping folds made in the top sheet portion of the bedskirt. U.S. Pat. No. 5,966,758 further describes a bed skirt whereby the adjustable height dust ruffles are mounted to detachable strips that allows for additional ruffles to be added to both form additional layers and more fullness to the dust ruffle and to fit a range of mattress sizes. However, these prior art advancements have maintained the vertical extended portion as a singular continuous piece of fabric along the majority length of the sides and foot end of the bed.

As a result of this continuous piece of fabric, as described in each of the above patents, a person would have difficulty raising the fabric in a specific or particular area to locate and retrieve an item from storage. Additionally, it is often a matter of privacy, especially among roommates, to keep their under-bed storage items from over exposure. It is an object of the present invention to overcome these limitations in the current prior art.

OBJECTS OF THE INVENTION

It is an object of the present invention to provide an improved bed skirt with multiple panels that runs along the entire length of each bedside and the entire width of the foot end of the bed.

It is a further object of the invention to provide an improved bed skirt whereby each vertical panel section has separate and independent movement from the other vertical panel sections.

Another object of the present invention is to provide a bed skirt that is easily raised in any particular or specified area.

Still a further object of the present invention is to provide a bed skirt that allows easy access to stored items underneath the bed while maintaining privacy along the remaining unraised sections of the bed skirt.

Still a further object of the present invention is to provide a bed skirt that allows the vertical panels to be interchanged with other vertical panels of varying heights.

Other objects and advantages of the current invention will be apparent to those skilled in the art from the following description of the drawings and the preferred embodiment.

SUMMARY OF THE INVENTION

The present invention is a bed skirt that specifically overcomes the drawbacks and limitations of the prior art bed skirts. The bed skirt has a top portion that is typically rectangular in shape and has approximately the same perimeter dimension of the mattress it is made for. A series of vertical panels or flaps is attached to the top portion and extends down to the floor. The vertical panels run along the entire width of each bedside and along the width of the foot end of the bed. Together the vertical panels totally enclose the underside of the bed on each bedside and at the foot end of the bed. Each vertical panel section allows for the independent upward movement of only that particular panel or section of the bed skirt. Each independent panel section allows for ease of access to storage containers or other items stored underneath the bed while maintaining privacy along the other sections of the bed skirt.

DETAILED DESCRIPTION OF THE PREFERRED EMBODIMENTS

The present invention will hereinafter be described more fully with reference to the accompanying drawings in which the preferred embodiments of the invention are shown. This invention may, however, be embodied in many different forms and should not be construed as limited to the embodiments set forth herein. Rather, these embodiments are provided for the purpose of a thorough and complete disclosure of the scope of the invention, which will fully be apparent to those skilled in the art. It is understood that when an element is referred as being "attached or connected to" another element, it can be with or without any other intervening elements. Moreover, each embodiment described or illustrated herein as being connected or attached includes all the means of connection or attachment as stated herein.

Figure 1:
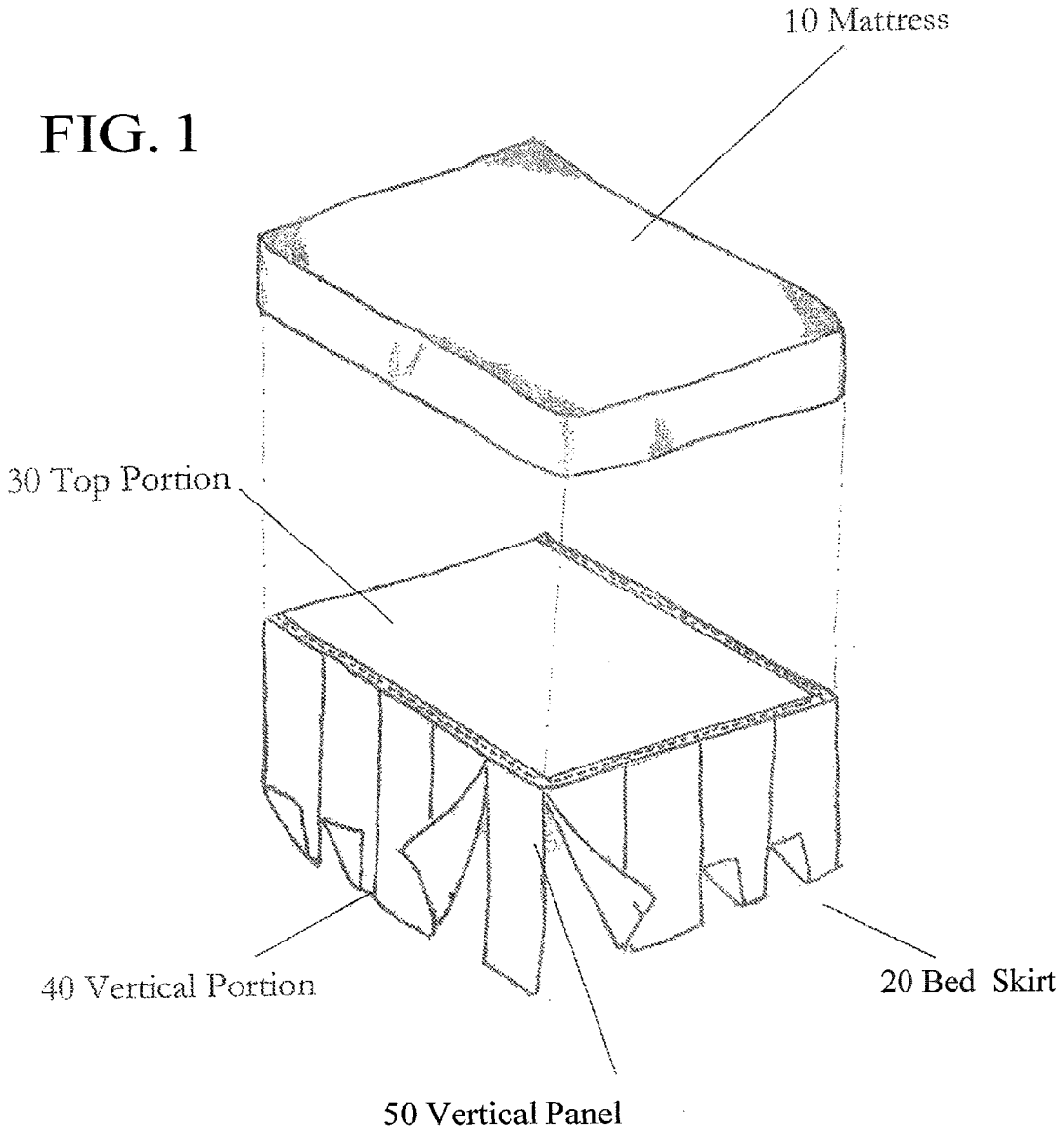
FIG. 1 is a perspective view of the preferred embodiment of the invention covering a conventional box spring of a bed with a convention bed mattress in an elevated position as viewed from the foot end of the bed toward the head end of the bed.
Figure 2:
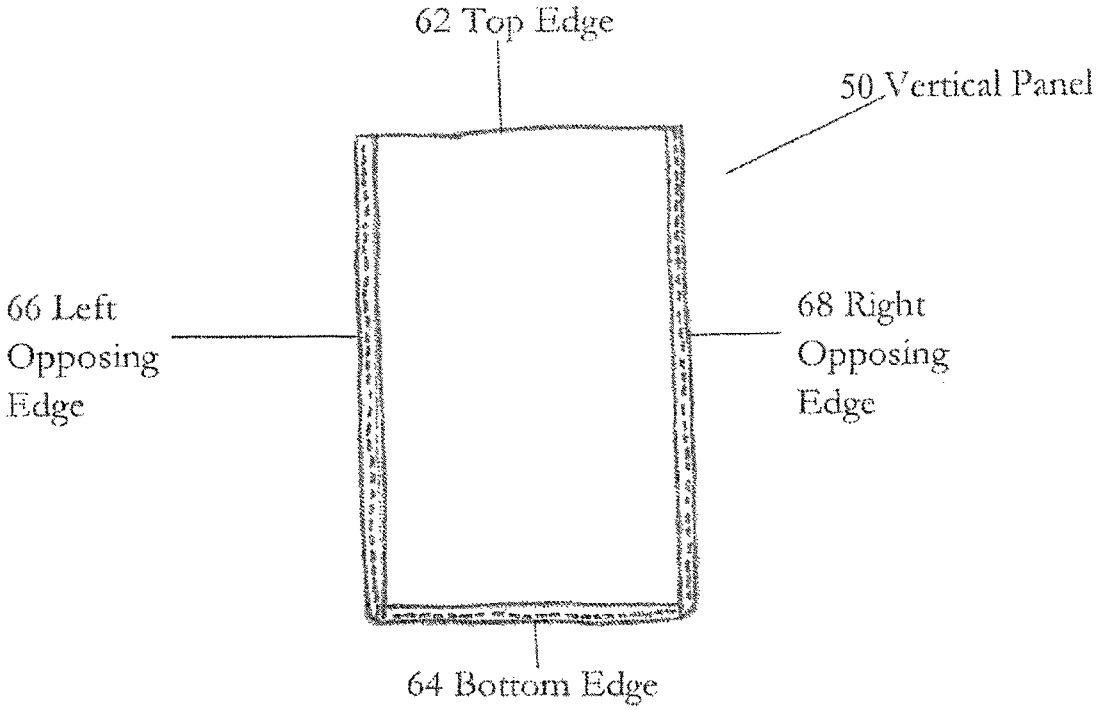
FIG. 2 is an enlarged perspective view a vertical panel of the preferred embodiment of the invention.

Referring now to FIGS. 1 and 2, a bed skirt 20 is shown while resting on a box spring as is generally utilized. A mattress 10 is shown that rests on the bed skirt 20 that gets sandwiched in between the mattress 10 and a box spring. It is the weight of the mattress 10 that rests on the bed skirt 20 that keeps the bed skirt 20 in place. Bed skirt 20 consists of a top portion 30 typically made of a flat fabric or sheet type material. The perimeter dimensions of top portion 30 are typically the same or approximately the same as the dimensions of the box spring that it covers. Thus the perimeter dimensions of bed skirt 20 for a twin size bed versus a full or double size bed versus a queen size bed versus a king size bed will all be different and according to the dimensions of the bed's box spring. Vertical portion 40 is a successive series of vertical panels 50 attached to the perimeter of top portion 30 at its top edge 62. Top edge 62 of vertical portion 40 may be attached to the top portion 30 through a multitude of methods. Examples include buttons, snaps, studs or rivets, hook and loop, zipper and other fastening methods. The most typical method of attachment is by means of sewing the top edge 62 of the vertical portion 40 to the perimeter of top portion 30. In a preferred embodiment, top edge 62 of vertical portion 40 is attached by being sewn or stitched to top portion 30.

Referring more specifically to FIG. 2, vertical panel 50 is shown with top edge 62. Top edge 62 is typically reinforced with a strip of fabric material. Top edge 62 of vertical panel 50 can be attached to the top portion 30 such that the left and right opposing edges of panel 50 (items 66 and 68 respectively) only touch an adjacent vertical panel 50. Thus the left opposing edge 66 would touch right opposing edge 68 of an adjacent panel and right opposing edge 68 would touch the left opposing edge 66 of an adjacent panel. This process would continue in succession until the full perimeter area of the box spring is covered. Alternatively, the part of top portion 30 that is at the head end of a bed can be left without a vertical portion 40. Leaving the head end of the bed and box spring open is a common practice as this area is often not seen since most beds have a head-board at its head end and the head end of the bed is often pushed against a wall to maximize the usable space in a bedroom.

Still a second alternative related to vertical panel 50 is that its top edge 62 can be attached to the perimeter of portion top portion 30 in such a manner that the opposing right edge 68 of vertical panel 50 overlaps the left opposing edge 66 of an adjacent panel. Again this would continue in succession until the full perimeter area of the box spring is covered or alternatively, as stated, the head end area of the bed and box spring can be left open and uncovered.

Moving further with FIG. 2, additionally, the height of vertical panel 50 is made such that it will hang from the perimeter of top portion 30 to a point just above the surface of the floor. It is an important part of this invention to allow for the maximum amount of available privacy for items stored underneath a bed. Thus vertical panel 50 can be made of a standard height of approximately 12-14 inches as is typical for covering the box spring and underside of most beds to a height of approximately 28-30 inches for covering the underside of dorm room style beds. In a preferred embodiment, the width of each vertical panel 50 is approximately 15 inches.

Figure 3:
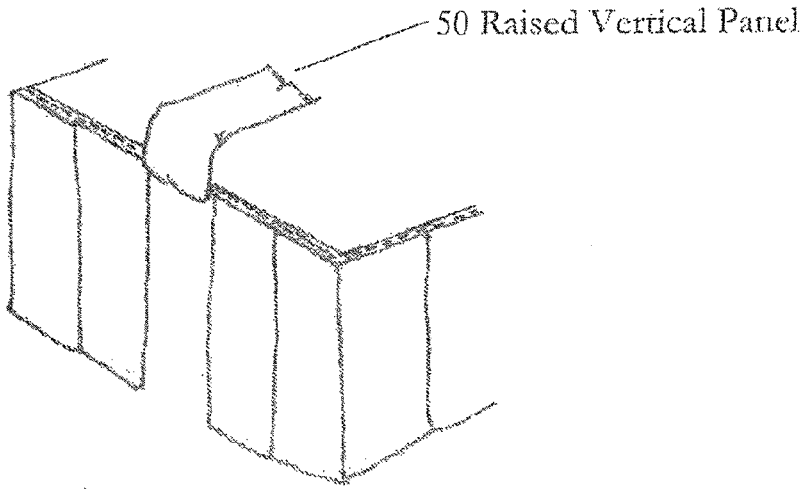
FIG. 3 is a cross-section of the bed skirt with the vertical panel section of the invention being featured with one panel in the raised position.

Referring now to FIG. 3, a cross-section of the bed skirt is shown with the focus on vertical portion 40. Vertical panel 50 of vertical portion 40 is shown in a raised position, which is another important part of the invention. Vertical panel 50 is attached by its top edge 62, as stated, to the perimeter of top portion 30 and can be raised at any degree angle up to 180 degrees with the bottom edge 64 of vertical panel 50 coming into touching relationship with the mattress 10. It is not construed however that vertical panel 50 could not be raised beyond 180 degrees but that is simply not an object of the invention. One primary objective of the invention is to allow easy access to items stored underneath a bed. By raising the bottom edge 64 of vertical panel 50 or any multiple of panels of vertical portion 40 as necessary, one can easily access items stored underneath the bed and easily replace those items without having to raise the entire vertical portion 40. In addition to ease of access of stored items, each vertical panel 50 moves independently of adjacent vertical panels and thus allow for the maximum amount of privacy of items stored underneath the bed while accessing one's stored items.

Changes may be made in the embodiments described or in the parts or elements of the embodiments or in any steps or sequence of steps described without departing from the spirit and/or scope of the invention as described in the claims as follows:

1. A compartmentalized bed skirt assembly for use on a box spring of a bed having a mattress and bedframe that rests on a floor surface comprising:

(a) a generally rectangular shaped top portion made of flat fabric material and having a perimeter with four edges that is substantially equal in dimension to a perimeter of the box spring;

(b) a plurality of vertical panels each having a top edge, a bottom edge, a left opposing edge and a right opposing edge, the plurality of panels being attached to each edge of the top portion;

(c) means for attaching the top edge of the vertical panels to the perimeter of the top portion; and (d) the vertical panels being attached to the top portion such that each opposing edge of a panel touches the opposite opposing edge of an adjacent panel so as to fully enclose the area beneath a bed.

2. The bed skirt assembly of claim 1 wherein the means for attaching the vertical panels are evenly spaced snaps attached to the perimeter of the top portion and the top edge of the vertical panels so as to come into interlocking relationship one to another when pressed together.

3. The bed skirt assembly of claim 1 wherein the vertical panels are attached such that right opposing edge of each panel overlaps the left opposing edge of the adjacent panel so as to fully enclose the area beneath a bed.

4. The bed skirt assembly of claim 1 wherein the vertical panels can be individually interchanged with vertical panels of varying heights to fit the area between the bedframe and the floor surface.

5. The bed skirt assembly of claim 2 wherein the vertical panels can be individually raised to any angle from zero to a point equaling to or surpassing 180 degrees or until the bottom portion of the vertical panel comes into touching contact with the mattress.

6. The bed skirt assembly of claim 5 wherein the vertical panels can be individually interchanged with vertical panels of varying heights to fit the area between the bedframe and the floor surface.

7. The bed skirt assembly of claim 1 wherein the means for attaching comprises buttons attached to the perimeter of the top portion and apertures formed in the top edge of the vertical panels for receiving the buttons the two being fixedly engaged one to another.

8. A method of making a compartmentalized bed skirt assembly for use on the box spring of a bed consisting of the steps of:

(a) providing a top portion of fabric material;

(b) cutting it to a size that substantially matches the perimeter of a box spring of which the bed skirt assembly is to cover;

(c) providing a plurality of vertical panels to attach to the top portion; and (d) attaching the vertical panels to the perimeter of the top portion such that each opposing edge of a panel touches the opposite opposing edge of an adjacent panel so as to fully enclose the area beneath a bed.

9. The method of claim 8, further consisting of the step of attaching the vertical panels to the perimeter of the top portion such that the opposing edge of each panel slightly overlaps the opposite opposing edge of the adjacent panel so as to fully enclose the area beneath the bed.

10. The method of claim 8 or 9, further consisting of the step of attaching the vertical panels in a method so as to avow each vertical panel to be individually lifted to any angle from zero to a point equaling to or surpassing 180 degrees or until the bottom portion of the vertical panel come into touching contact with the mattress.

11. The method of claim 8 or 9, further consisting of the step of attaching the vertical panels to the top portion in a method so as to allow vertical panels to be individually interchanged with vertical panels of varying heights to fit the area between the bedframe and the floor surface.

* * * * *